United States Patent [19]

Hart et al.

[11] 4,205,025

[45] May 27, 1980

[54] SYNTHETIC POLYMERIC FIBRIDS, FIBRID PRODUCTS AND PROCESS FOR THEIR PRODUCTION

[75] Inventors: John R. Hart; Donald W. Lare, both of Hamilton, Ohio; James J. Nault, Appleton, Wis.

[73] Assignee: Champion International Corporation, Stamford, Conn.

[21] Appl. No.: 643,501

[22] Filed: Dec. 22, 1975

[51] Int. Cl.[2] ..... B29C 23/00

[52] U.S. Cl. ..... 264/14; 162/146; 162/157 R; 264/140

[58] Field of Search ..... 162/157 R, 157 C; 264/187, 186, 11, 14, 149; 106/169

[56] References Cited

U.S. PATENT DOCUMENTS

| | | | |
|---|---|---|---|
| 2,687,944 | 8/1954 | Johnson et al. | 264/187 |
| 2,999,788 | 9/1961 | Morgan | 162/157 C |
| 3,114,672 | 12/1963 | Schott | 162/157 C |
| 3,114,747 | 12/1963 | Campbell | 162/157 C |

*Primary Examiner*—Richard V. Fisher
*Assistant Examiner*—Peter Chin
*Attorney, Agent, or Firm*—Evelyn M. Sommer

[57] ABSTRACT

Polymeric fibrids and paper-like structures produced therefrom are disclosed. These fibrids are produced by preparing an aqueous solution of a film forming polymer, injecting the solution into a liquid precipitating medium miscible with water but in which the polymer is insoluble, and providing sufficient shear to directly and rapidly precipitate the polymer to fibrid morphology. The fibrids, which are desirably first treated to render them more hydrophobic, may be formed into a web and dried utilizing conventional paper-making techniques to obtain the paper-like structures of the invention.

6 Claims, No Drawings

SYNTHETIC POLYMERIC FIBRIDS, FIBRID PRODUCTS AND PROCESS FOR THEIR PRODUCTION

INTRODUCTION TO THE INVENTION

The present invention relates to fibrids composed of naturally occurring, or modified naturally occurring, polymeric materials exhibiting film forming ability.

The present invention further includes a method for producing fibrids from polymer having film forming characteristics. This method comprises preparing an aqueous solution of the film forming polymer, injecting the solution into a liquid medium which is miscible with water but in which the polymer is insoluble under conditions of shear sufficient to precipitate fibers of the polymer characterized by fibrid morphology.

The present invention further includes the treatment of the present polymer with insolubilizing agents which, by rendering it more hydrophobic, reduce its aqueous solubility and thereby provides improved fibrids suitable for use in conventional aqueous-based paper-making processes.

Finally, the present invention also includes synthetic paper-like structures composed wholly, or partly, of the present polymeric fibrids.

DESCRIPTION OF THE INVENTION

The polymers from which the fibrids and paper-like structures of the present invention are formed belong to that class of naturally occurring, or modified naturally occurring, polymeric materials characterized by its film forming ability. These materials are well known in the prior art and comprise water-soluble polymers of high molecular weight, ordinarily of at least about 50,000.

The many members of the class of polymers exhibiting this "film forming" characteristic are well known. Among the more common natural members are the polysaccharide carbohydrates—e.g., starch, dextran, gum arabic, glycogen and pectin and the proteins—e.g., casein, zein and gelatin. Many modified natural polymers are also recognized for their film forming ability. Exemplary of these are methyl and ethyl cellulose, viscose solutions (dissolved cellulose), cellulose nitrates and triacetates, sodium alginates and ethylated starch. Additionally, other modified polymers useful herein include the longer chain adducts resultant from reacting the above polymers with such linking agents as formaldehyde and glyoxal. Finally, even crude mixtures of polymer—for example, the by-product stream of paper pulping processes—exhibit this requisite film forming characteristic.

Although each of the above-indicated polymers is individually useful in the production of the present fibrids and other products, it is also within the scope of the present invention to utilize polymeric fibrid compositions comprising admixtures of such film forming polymers or admixtures of one or more of the foregoing polymers with non-film forming polymers, staple fiber, cotton, non-cellulose, etc.

In addition in accordance with another embodiment of the invention, inorganic pigments such as $TiO_2$ and also organic pigments such as microcapsules, for instance the microspheres described in U.S. Pat. Nos. 3,293,114 and 3,556,934 can be slurried with the dissolved polymer and are thereafter entrapped or incorporated into the fibrids during the subsequent precipitation step.

Admixture and use of the present polymer in combination with secondary film forming polymer is particularly preferred. Either fibrids, fibers or both may be present in such a combination. It is particularly desired, however, to provide a structural framework within the present paper and paper-like products about which the present polymer, or copolymer in the case of a blend with a secondary polymer such as polyvinyl alcohol and polyethylene oxide, may precipitate. In this way there is improved fibrid formation and better structural integrity than if only the present polymer is used. Therefore, it is preferred that the aqueous solution of film forming polymer also contain secondary polymer having a high molecular weight linear chain, such as polyvinyl alcohol or polyethylene oxide. In this way, the mixed morphology of the product resultant from precipitation will yield the advantages of both sets of respective physical characteristics.

Thus the present invention is inclusive of utilization of large numbers of different polymers and is not intended to be restricted in scope to only the individual examples set forth above. In each instance, however, this invention does require the presence of at least one fibrid-producing polymer falling within the class known to possess the film forming ability.

In accordance with the present process, the aforementioned film forming polymers are first dissolved to form an aqueous solution. This step is easily performed in view of the fact that the present film forming materials are all water soluble. The resultant solution should, however, be of sufficient concentration and viscosity, so as eventually to permit the efficient formation of fibers of desirable physical dimensions and integrity. These latter fiber characteristics are most easily ensured through the utilization of polymeric solutions having a concentration of from about 0.5 to about 10%, preferably from about 2 to 6%, polymer by weight of water.

The viscosity of the aqueous polymeric solution will vary dependent upon the molecular weight of the particular film forming polymer utilized. The maximum viscosity is dictated by the ability to extrude, inject, spin or otherwise force a solution of the polymer into the precipitating bath. The lower limit of viscosity is a function of concentration limitations and economic considerations. Viscosity may be altered as desired, e.g., by elevating the temperature or by adding a lower molecular weight fraction or through the addition of viscosity regulating agents.

The aqueous solution of polymer is then utilized to produce polymeric fibers. This step may be accomplished by injecting the solution into a precipitating medium under conditions of shear. Thus, for example, a spray gun or spinneret may be utilized to project a thin stream of the present solution into the liquid medium in which the polymeric fibers are formed.

This transformation of a stream of polymeric solution into solid polymer occurs by virtue of the insolubility of the film forming polymer in the medium. Further, in order to ensure good fiber formation, however, it is desirable that such precipitating medium be one which is miscible with water. In this manner, the aqueous component of the injected stream is quickly dispersed, thus facilitating the integrity and compaction of the resultant fibers of water-soluble polymer.

Any non-solvent for the present polymers is useful as a precipitating medium for fiber formation, and such liquids are well known in the prior art. Desirably, however, the precipitating medium should be organic and may, for example, comprise at least one alcohol or ketone of molecular weight less than about 100. Thus, preferred precipitating media include methanol, ethanol, isopropyl alcohol or other propanols, acetone, and admixtures thereof. Solutions of acids or salts are also useful precipitating media, for example, in the case of proteins, e.g., casein and alginate.

It is additionally desirable that the precipitating medium provide a quenching or crystallizing effect upon the injected stream of polymeric solution. This effect is brought about by maintaining a temperature differential between the aqueous polymeric solution and the precipitating medium, so as to cause the rapid cooling of the polymer upon injection. Such a temperature differential should ordinarily be of at least about 30 centigrade degrees and results in the production of fibers of preferred physical properties.

The polymeric fibers are produced in fibrid form. This is brought about by the combined actions of the precipitating medium and high shear forces.

Refining is an optional finishing step which may be carried out using therefor myriad non-solvent media. For maximum convenience, the refining may simply be performed in the initial precipitating medium. A different medium may also be utilized however. Thus, for example, for the advantages and the manner of carrying out refining copending Application Ser. No. 496,096 of D. Lare filed Aug. 9, 1974, is incorporated herein by reference.

The polymer fibrids are in a form suitable for use in producing synthetic paper and paper-like products. Thus a slurry of the fibrids in a non-solvent therefor—either the precipitating medium, or any other such medium to which they are transferred—may be formed into a web and then dried. There are, however, certain drawbacks of this embodiment of the present invention, dependent upon the particular non-solvent selected. For example, all such non-solvents are more expensive than water and further, most embue the product with disagreeable characteristics such as discoloration or odor through residual traces of the non-solvent. Thus the use of water as a slurrying medium is more desirable.

As noted previously, however, the film forming polymers of the present invention are water soluble. Accordingly, utilization of fibrids produced therefrom would be limited by the fact that they could not be processed into paper-like structures by the conventional techniques which involve aqueous slurries of paper precursors. A further step in accordance with the present process, therefore comprises treatment of the polymeric fibrids so as to render them more hydrophobic, decrease their solubility in water and so permit their suspension in water. This step makes possible the formation of aqueous slurries of the present fibrids, and thus renders them suitable for conventional further processing techniques.

Treatment of the present polymers to decrease their solubility in water may be performed with a number of different insolubilizing agents. Thus, for example, an organic fatty acid, such as stearic, oleic or rosin acid may be contacted with the polymer so as to effect adsorption thereon. In another technique, concentrated aqueous solutions of insolubilizing inorganic salts such as magnesium, aluminum and ammonium sulfate, and aluminum chloride may be contacted with the polymer. Alternatively, polymers can be acylated with, for example, acetic anhydride. In still other techniques, polymer may be treated to produce cross-linking through their reactive functional groups. For instance, polymers having hydroxyl groups may be reacted with formaldehyde or glyoxal, and polymers having carboxyl groups, with amino resins such as melamine and urea-formaldehyde.

These are only a few examples of the means by which the present film forming polymers may be made more hydrophobic. They, and others, are well known. Thus this step of decreasing the solubility of polymer in water regulates the stability of the polymers in an aqueous medium and may be accomplished utilizing any of the recognized insolubilizing agents available in the art. The degree of insolubility may be controlled to provide such stability in aqueous media as may be necessary to fabricate the desired web. Insolubility can be decreased to provide stability during the entire paper making process, or to an extent so as to provide a timed-insolubility useful for producing porous webs. It is further noted that the aqueous insolubilization of polymer may be performed at various steps of the present process. Thus, for example, a suitable insolubilizing agent may be added conjunctively with the initial aqueous stream of polymeric material, or to the precipitating medium, so as to result in the formation of polymeric fibers which initially evidence a reduced water solubility. Alternatively, the fibers can be treated after formation by, for example, transfer from the precipitating medium into a second solution which contains an insolubilizing agent.

The increase in hydrophobic character can even be produced by isolating the fibers or resultant fibrids and thereafter contacting the polymer with a solution containing an insolubilizing agent—for example, acetic anhydride. Indeed, the only prerequisite of this step is that the polymer be treated to increase its hydrophobic character prior to, or coincident with, contact of the resultant fibers or fibrids with a substantially aqueous solution in which its morphology would be destroyed through dissolution.

Once the hydrophobic fibrids of the present invention have been prepared, they may be utilized or treated in the same manner as is naturally occurring paper pulp in the manufacture of paper and paper-like structures. Thus, the fibrids are ordinarily slurried in water, formed into a web, and then dried so as to produce products useful in the same manner as ordinary paper. Moreover, if desired, the present fibrids may be admixed with other customary paper ingredients including naturally occurring and other polymeric synthetic pulps to form composite paper-like structural products. Additionally, the conventional paper-making additives such as sizing agents, retention aids, dyes, fillers, pigments, etc. are compatible with the present fibrids. Significantly, however, many of these conventional paper additives are of reduced importance in the present paper products, due largely to the ability to control these products' properties with the present insolubilizing agents and because these polymers inherently yield a white or opaque, instead of the usual clear, film appearance.

This invention is further described by the following examples in which all proportions are, unless otherwise specified, on the basis of weight percent.

EXAMPLE 1

A 1.0 percent solution of high viscosity grade (200,000 mw) carboxymethyl cellulose was prepared by adding the cellulose to vigorously agitated water. 6 gm of the solution were then extruded into 200 ml of 80% isopropyl alochol agitated with high shear in a Waring blender. After extrusion was completed, refining of the fibers in the blender continued for 30 seconds, and the product fibrids were then collected on a 270 mesh screen. Fibrid production was repeated until there was a total of 6 grams of product.

The fibrids were then vacuum filtered to remove most of the adherent isopropyl alcohol. Sufficient acetic anhydride was then added to cover the fibers, and the mixture was shaken and permitted to stand for 2 hours at room temperature. Thereafter, the admixture was again filtered and the fibrids vacuum dried. 3 grams of the dried fibrids were then washed with distilled water to remove acetic acid, redispersed in water, and then cast and dried to form a coherent hand sheet of paper.

EXAMPLE 2

A solution of 5% amylomaize (70% amylose) was prepared by cooking an aqueous starch slurry in an autocave at 160° C. for 20 minutes. This solution was then processed in the same manner set forth in Example 1 and a hand sheet of paper was successfully formed therefrom.

EXAMPLE 3

A 5% cornstarch solution was prepared by cooking an aqueous slurry of starch for one-half hour at 90° C. An alcoholic slurry of starch fibrids was then formed by the same process set forth in Example 1.

One-half of the alcoholic slurry was then treated with acetic anhydride for 18 hours, again as set forth in Example 1. Only limited insolubility was observed. The second half of the alcoholic slurry was filtered and then added to an alcohol solution containing 1 gram of stearic acid. This solution was then dried in an oven at 100° C. The dried fibers were washed twice with 50 ml aliquots of isopropyl alcohol to improve their dispersability in water, and an aqueous slurry was found to cast successfully into a hand sheet of paper.

The run was repeated under substantially the same conditions using a lesser amount of stearic acid. The fibrids could then be directly dispersed in water and formed into paper sheets of similar properties.

EXAMPLE 4

A starch-polyvinyl alcohol-glyoxal (100:10:10) solution of 6% solids was prepared by cooking an aqueous slurry thereof for one-half hour at 90° C. Polymeric fibrids were then formed from the resultant slurry by the process set forth in Example 1. One-half of the fibrids were treated with acetic anhydride, permitted to stand for 2 hours, and the slurry then filtered. The fibrids were vacuum dried, and then washed with distilled water to remove acetic acid. They evidenced only limited stability, undergoing swelling and some solubilization in less than 1 hour.

The second half of the fibrids were treated with stearic acid in the same manner as set forth in Example 3. In this case, the fibrids were successfully dispersed in water and evidenced stability for a long period of time, thus permitting successful formation of a hand sheet of paper thereon.

EXAMPLE 5

A 2.0% solution of medium viscosity grade (100,000 MU) carboxymethyl cellulose was prepared and fibrids were collected in the same manner as Example 1. The fibrids were treated with a concentrated solution of aluminum sulfate washed twice with water, redispersed and then cast and dried to form a coherent handsheet of paper.

I claim:

1. A process for the production of synthetic paper pulp product comprising preparing an aqueous solution of naturally occurring or modified naturally occurring film forming polymer which has been treated to render it more hydrophobic, injecting said solution into a liquid organic precipitating medium miscible with water but in which said polymer is insoluble and which precipitating medium additionally contains an agent which will render the polymer more hydrophobic, and providing sufficient shear to precipitate said polymer in fibrid morphology.

2. The process of claim 1, wherein the agent comprises a fatty acid.

3. The process of claim 1, wherein the polymeric fibrids are transferred to a treating medium containing a treating agent which will render the polymeric fibrids more hydrophobic.

4. The process of claim 3, wherein the treating medium comprises a liquid organic non-solvent for the polymer and an agent which will render the polymeric fibrids more hydrophobic.

5. The process of claim 3, wherein the treating medium comprises an aqueous solution of an inorganic salt which will render the polymer fibrids more hydrophobic.

6. The process of claim 1, wherein the polymeric fibrids are removed from the precipitating medium and treated with acetic anhydride to render them more hydrophobic.

* * * * *